US009644292B2

(12) United States Patent
Kino et al.

(10) Patent No.: US 9,644,292 B2
(45) Date of Patent: May 9, 2017

(54) METHOD FOR KNITTING KNITTED FABRIC

(71) Applicant: SHIMA SEIKI MFG., LTD., Wakayama-shi, Wakayama (JP)

(72) Inventors: Takashi Kino, Wakayama (JP); Masamitsu Ikenaka, Wakayama (JP)

(73) Assignee: SHIMA SEIKI MFG., LTD., Wakayama (JP)

( * ) Notice: Subject to any disclaimer, the term of this patent is extended or adjusted under 35 U.S.C. 154(b) by 0 days.

(21) Appl. No.: 14/785,085

(22) PCT Filed: Mar. 28, 2014

(86) PCT No.: PCT/JP2014/059172
§ 371 (c)(1),
(2) Date: Oct. 16, 2015

(87) PCT Pub. No.: WO2014/174990
PCT Pub. Date: Oct. 30, 2014

(65) Prior Publication Data

US 2016/0122913 A1 May 5, 2016

(30) Foreign Application Priority Data

Apr. 23, 2013 (JP) ..... 2013-090653

(51) Int. Cl.
*D04B 1/22* (2006.01)
*D04B 1/24* (2006.01)
*D04B 7/10* (2006.01)

(52) U.S. Cl.
CPC ..... *D04B 1/22* (2013.01); *D04B 1/24* (2013.01); *D04B 7/10* (2013.01)

(58) Field of Classification Search
CPC ... D04B 1/22; D04B 1/24; D04B 7/20; D04B 7/28

(Continued)

(56) References Cited

U.S. PATENT DOCUMENTS 5,174,134 A 12/1992 Okuno
5,271,249 A * 12/1993 Mitsumoto ..... D04B 1/246 66/172 R (Continued)

FOREIGN PATENT DOCUMENTS

EP 2366820 A1 9/2011
EP 2540887 A2 1/2013

(Continued)

OTHER PUBLICATIONS

European Search Report issued Oct. 4, 2016, in corresponding European Application No. 14787902.7, 8 pages.

*Primary Examiner* — Danny Worrell
(74) *Attorney, Agent, or Firm* — Rothwell, Figg, Ernst & Manbeck, P.C.

(57) ABSTRACT

There is provided a method for knitting a knitted fabric, different from a conventional method, of forming a suppressing section for suppressing a stretch in the knitting width direction of the knitted fabric in the knitting process of the knitted fabric.

One side in a longitudinal direction of needle beds (FB, BB) is assumed as a moving direction (DR). A suppressing section (4) is formed by repeating performing of a bind-off process, in which a first stitch (11) held on one needle bed (FB) is overlapped with a second stitch (12) that is proximate in the moving direction (DR) and a retaining stitch (15) is knitted following in a wale direction of a double stitch (13) of the first stitch (11) and the second stitch (12), and forming of a new base stitch (14) branched from at least one of the first stitch (11) and the second stitch (12).

3 Claims, 4 Drawing Sheets

(58) Field of Classification Search
USPC ..... 66/64, 60 R, 75.1, 172 R, 69
See application file for complete search history.

(56) References Cited

U.S. PATENT DOCUMENTS

| | | | | | |
|---|---|---|---|---|---|
| 5,456,096 | A * | 10/1995 | Mitsumoto | D04B 1/22 | 66/172 R |
| 5,669,244 | A * | 9/1997 | Okuno | D04B 1/22 | 66/172 R |
| 5,836,177 | A * | 11/1998 | Okuno | D04B 7/00 | 66/176 |
| 6,571,584 | B1 * | 6/2003 | Okayama | D04B 1/24 | 66/176 |
| 6,658,898 | B2 * | 12/2003 | Okamoto | D04B 1/24 | 66/172 R |
| 6,761,048 | B2 * | 7/2004 | Okamoto | D04B 1/22 | 66/172 R |
| 6,789,402 | B2 * | 9/2004 | Okamoto | D04B 1/246 | 66/176 |
| 6,892,555 | B2 * | 5/2005 | Kubo | D04B 1/24 | 66/64 |
| 2002/0189299 | A1 | 12/2002 | Okamoto | | |
| 2009/0100878 | A1 | 4/2009 | Miyai | | |

FOREIGN PATENT DOCUMENTS

| | | | |
|---|---|---|---|
| GB | 404418 | A | 1/1934 |
| JP | 7-65258 | B2 | 7/1995 |
| JP | 08-100352 | A | 4/1996 |
| JP | 2008-214775 | A | 9/2008 |
| JP | 4848370 | B2 | 10/2011 |
| JP | 2012-117175 | A | 6/2012 |
| JP | 2012-122175 | A | 6/2012 |
| WO | 01/48286 | A1 | 7/2001 |

* cited by examiner

METHOD FOR KNITTING KNITTED FABRIC

CROSS REFERENCE TO RELATED APPLICATION

This application is a 35 U.S.C. 371 National Phase Entry Application from PCT/JP2014/059172, filed Mar. 28, 2014, which claims the benefit of Japanese Patent Application No. JP2013-090653 filed on Apr. 23, 2013, the disclosure of which is incorporated herein in its entirety by reference.

TECHNICAL FIELD

The present invention relates to a method for knitting a knitted fabric of forming a suppressing section for suppressing stretch in a knitting width direction of the knitted fabric in the middle of a wale direction of the knitted fabric.

BACKGROUND ART

When knitting a knitted fabric using a flat knitting machine, a suppressing section for suppressing the stretch in the knitting width direction of the knitted fabric is sometimes partially formed in the middle of the wale direction of the knitted fabric. For example, Patent Document 1 discloses a method for knitting a knitted fabric that provides thickness to the knitted fabric and that suppresses the stretch in the knitting width direction of the knitted fabric by periodically repeating knit, tuck, and miss. A knitted fabric partially formed with the suppressing section can be knitted by forming the suppressing section using the method for knitting the knitted fabric described in Patent Document 1.

PRIOR ART DOCUMENT

Patent Document

[Patent document 1] Japanese Patent Publication No. 4848370

SUMMARY OF THE INVENTION

Problems to be Solved by the Invention

However, the suppressing section knitted with the method for knitting the knitted fabric of Patent Document 1 is less likely to contract compared to a plain stitch section knitted with plain stitches, and is fixed in a state already spread in the knitting width direction at the time of knitting. Thus, the suppressing section may sometimes look loose.

The present invention has been made in light of the foregoing and an object of the present invention is to provide a method for knitting a knitted fabric, different from a conventional method, of forming a suppressing section for suppressing the stretch in the knitting width direction of the knitted fabric in the middle of the wale direction of the knitted fabric.

Means for Solving the Problems

As a result of thoroughly reviewing the method for knitting the knitted fabric of forming a suppressing section in the middle of the wale direction of the knitted fabric, the inventors of the present invention conceived the idea of applying the bind-off process when forming the suppressing section. The bind-off process is a known knitting method (see e.g., Japanese Examined Patent Publication No. 7-65258) in which an overlapping of a stitch (first stitch) held on a needle bed and its adjacent stitch (second stitch) and a knitting of a stitch (retaining stitch) following in the wale direction of a double stitch including the first stitch and the second stitch are repeated. In the bind-off process, a plurality of proximate stitches are overlapped and fixed, and hence the stretch in the knitting width direction of the bind-off processed portion is suppressed. However, the bind-off process is normally not used in the middle of the wale direction of the knitted fabric. This is because the bind-off process is a process that prevents a terminating end in the wale direction of the knitted fabric from unraveling, and the knitted fabric is removed from the needle bed by carrying out the bind-off process. Thus, when applying the bind-off process, which is conventionally not used in the middle of the wale direction of the knitted fabric, to the middle of the wale direction of the knitted fabric, the inventors of the present invention conceived knitting a new base stitch that becomes a base branched from the bind-off processed portion and achieved the method for knitting the knitted fabric of the present invention. The method for knitting the knitted fabric of the present invention will be described below.

An aspect of the present invention relates to a method for knitting a knitted fabric of forming a suppressing section for suppressing stretch in a knitting width direction of the knitted fabric in the middle of a wale direction of the knitted fabric using a flat knitting machine including at least a pair of a front and a back needle bed and in which stitches are transferrable between the front and back needle beds. In the method for knitting the knitted fabric of the present invention, assuming one side in a longitudinal direction of the needle beds is a moving direction, the suppressing section is formed by repeating performing of a bind-off process, in which a first stitch held on one needle bed is overlapped with a second stitch that is proximate in the moving direction and a retaining stitch is knitted following in a wale direction of a double stitch of the first stitch and the second stitch, and forming of a new base stitch branched from at least one of the first stitch and the second stitch.

A known bind-off process can be used for the bind-off process in the present invention. A loop length of the stitches of the suppressing section is preferably made smaller than a loop length of the stitches of the portion other than the suppressing section. The stretch of the suppressing section thus can be effectively suppressed. Alternatively, the method for knitting the knitted fabric of the present invention may be applied to every few stitches lined in the knitting width direction. For example, the performing of the method for knitting the knitted fabric of the present invention on the odd-numbered stitches in the knitting width direction and the performing of the method for knitting the knitted fabric of the present invention on the even-numbered stitches may be alternately or sequentially carried out. In this case, the distance of moving the first stitch becomes long and the first stitch becomes a stretched state, and thus the stretch of the suppressing section can be further suppressed.

In order to branch the new base stitch from the first stitch (second stitch), the new base stitch is preferably knitted so that the first stitch (second stitch) and the new base stitch are in a directly connected state, or the split knitting is preferably carried out on the first stitch (second stitch). The split knitting is a known knitting method (see e.g., Japanese Patent Publication No. 2604653).

According to one aspect of the method for knitting the knitted fabric of the present invention, process $\alpha_1$ and process $\alpha_2$ may be repeated.

[Process $\alpha_1$] Moving the first stitch that serves as a basis in the moving direction and overlapping the first stitch and the second stitch that is proximate to the first stitch in the moving direction on the one needle bed to form the double stitch.

[Process $\alpha_2$] Continuously carrying out forming of the new base stitch on a knitting needle of the one needle bed, on which the first stitch was held before being moved, and knitting of the retaining stitch following in the wale direction of the double stitch formed in the process $\alpha_1$. Provided that, when repeating the process $\alpha_1$ and process $\alpha_2$, the retaining stitch in the $n^{th}$ process $\alpha_2$ is assumed as the first stitch in the $n+1^{th}$ process $\alpha_1$, and $n+1^{th}$ process $\alpha_1$ is carried out (n is a natural number greater than or equal to one).

According to another aspect of the method for knitting the knitted fabric of the present invention, process $\beta_2$ and process $\beta_3$ may be repeated after process $\beta_1$ is carried out.

[Process $\beta_1$] Carrying out split knitting continuously on the first stitch that serves as a basis and on a plurality of moving side stitches lined in the moving direction with respect to the first stitch to transfer the first stitch and the moving side stitches from the one needle bed to the other needle bed, and knitting a plurality of the new base stitches on the knitting needles of the one needle bed, on which the first stitch and the moving side stitches were held.

[Process $\beta_2$] Defining the moving side stitch that is proximate to the first stitch in the moving direction, among the moving side stitches transferred to the other needle bed by the split knitting of the process $\beta_1$, as the second stitch, and moving the first stitch in the moving direction and overlapping the first stitch and the second stitch on the other needle bed to form the double stitch.

[Process $\beta_2$] Knitting the retaining stitch following in the wale direction of the double stitch formed in the process $\beta_2$.

Provided that, when repeating the process $\beta_2$ and process $\beta_3$, the retaining stitch in the $n^{th}$ process $\beta_3$ is assumed as the first stitch in the $n+1^{th}$ process $\beta_2$, and $n+1^{th}$ process $\beta_2$ is carried out (n is a natural number greater than or equal to one).

According to another aspect of the method for knitting the knitted fabric of the present invention, processes $\gamma_1$, $\gamma_2$, and $\gamma_3$ may be repeated.

[Process $\gamma_1$] Carrying out split knitting on the first stitch that serves as a basis, to transfer the first stitch from the one needle bed to the other needle bed, and knitting the new base stitch on the knitting needle of the one needle bed on which the first stitch was held.

[Process $\gamma_2$] Defining a stitch that was proximate to the first stitch in the moving direction on the one needle bed before carrying out the split knitting as the second stitch and moving the first stitch in the moving direction and overlapping the first stitch and the second stitch on the one needle bed to form the double stitch.

[Process $\gamma_3$] Knitting the retaining stitch following in the wale direction of the double stitch formed in the process $\gamma_2$.

Provided that, when repeating the processes $\gamma_1$, $\gamma_2$, and $\gamma_3$, the retaining stitch in the $n^{th}$ process $\gamma_3$ is assumed as the first stitch in the $n+1^{th}$ process $\gamma_1$, and $n+1^{th}$ process $\gamma_1$ is carried out (n is a natural number greater than or equal to one).

According to the method for knitting the knitted fabric of the present invention, the suppressing section is less likely to stretch since the bind-off process is used when forming the suppressing section. This is because in the bind-off process, the double stitch is formed by overlapping the first stitch and the second stitch that are proximate to each other, and hence the movement in the knitting width direction of the first stitch and the second stitch is restricted.

Furthermore, in the method for knitting the knitted fabric of the present invention, the bind-off process is carried out, and the new base stitch branched from one of the first stitch and the second stitch that are overlapped by the bind-off process is formed. That is, in place of the first stitch and the second stitch being removed from the needle bed by the bind-off process, the new base stitch branched from the first stitch or the second stitch is formed on the needle bed. Thus, the knitting of the knitted fabric can be continued with the new base stitch as a base.

MODE FOR CARRYING OUT THE INVENTION

Embodiments of the present invention will be hereinafter described based on the drawings. The knitting shown in the embodiments is all knitting examples using a two-bed flat knitting machine including at least a pair of a front and a back needle bed and in which stitches can be transferred between the front and back needle beds. The flat knitting machine used in the method for knitting the knitted fabric of the present invention is not, of course, limited to the two-bed flat knitting machine, and may be, for example, a four-bed flat knitting machine.

<First Embodiment>

In a first embodiment, a specific example of a method for knitting a knitted fabric of the present invention of knitting a suppressing section for suppressing stretch in a knitting width direction of the knitted fabric in the middle of a wale direction of the knitted fabric will be described based on a knitting process diagram of FIG. 1. The application object is not particularly limited, and for example, may be a sweater, knit pants, or shoe upper as shown in a fourth embodiment, to be described later.

<<Knitting Process>>

Figure 1:
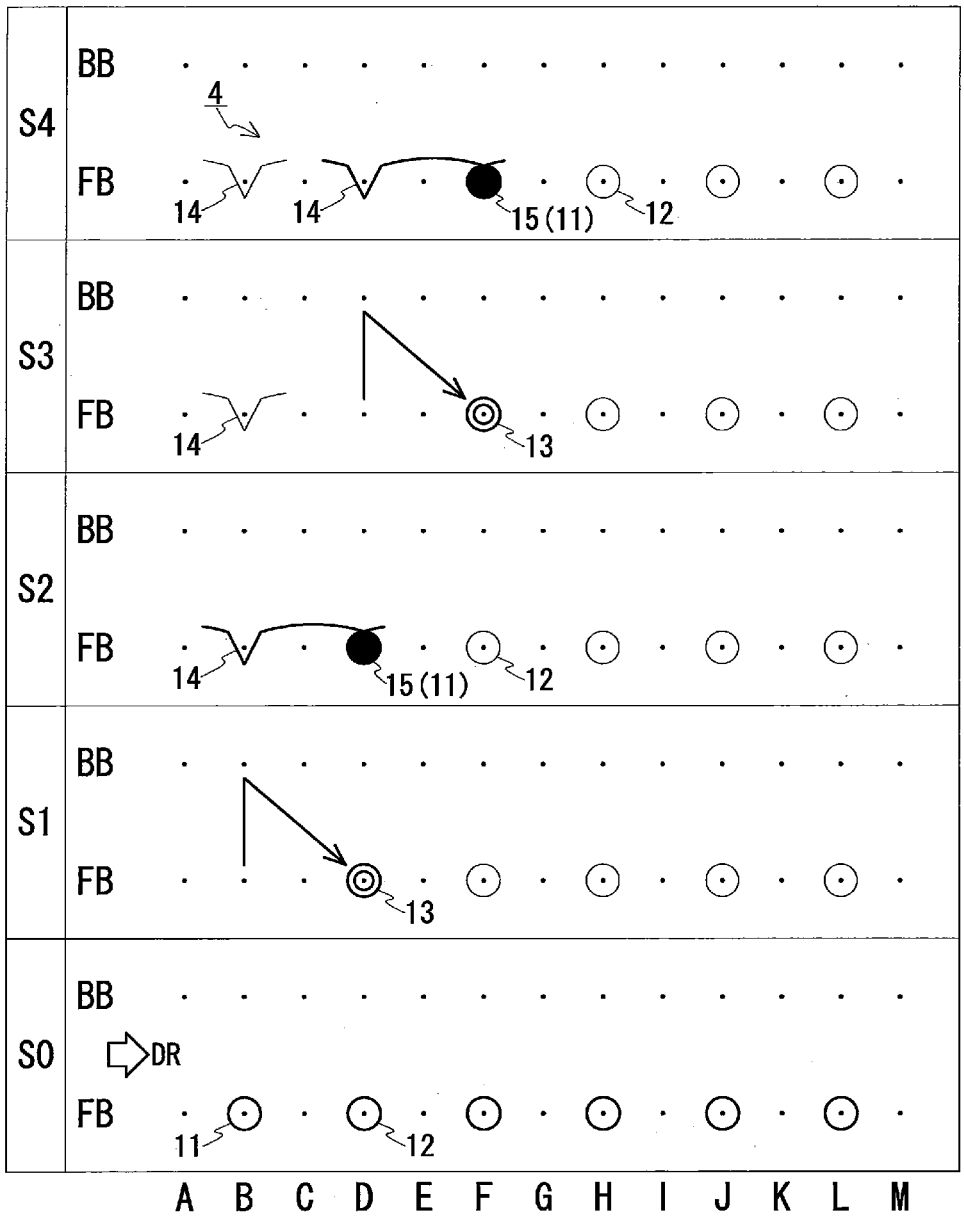
FIG. 1 is a knitting process diagram of a method for knitting a knitted fabric of the present invention shown in a first embodiment.

"Alphabet+number" in a left column in a knitting process diagram of FIG. 1 indicates the number of a knitting process, and a right column indicates a held state of the stitches in each knitting process. A black dot in the right column indicates a knitting needle arranged in a front needle bed (hereinafter referred to as FB) and a back needle bed (hereinafter referred to as BB), an arrow indicates a direction of transfer of a stitch, ○ indicates an old stitch, • indicates a newly knitted stitch, ◎ indicates a double stitch, and V-mark indicates a pickup stitch. The upper case alphabets A to M in the figure indicate the positions of the knitting needles, and an outlined arrow indicates the direction of a moving direction DR (one side in longitudinal direction of FB, BB). The manner of seeing FIGS. 2 and 3, to be described later, is similar to FIG. 1.

S0 shows a state in which stitches of a knitted fabric in the process of knitting are held on knitting needles B, D, F, H, J, and L of the FB. From this state, a suppressing section 4 (see S4) of suppressing stretch in a knitting width direction of the knitted fabric is knitted. First, a first stitch 11 that serves as a basis for starting the knitting of the suppressing section 4 is determined. In the present embodiment, the stitch held on the knitting needle B of the FB is assumed as the first stitch 11. Furthermore, in the present embodiment, the stitch held on the knitting needle D of the FB is assumed as a second stitch 12 to be overlapped with the first stitch 11 in the bind-off process, to be described later. The second stitch 12 is a stitch that is proximate to the first stitch 11 in the moving direction DR on the FB.

In S1, the first stitch 11 held on the knitting needle B of the FB is moved in the moving direction DR, and overlapped with the second stitch 12 held on the knitting needle D of the FB (corresponding to first process $\alpha_1$). The transfer of the stitch and the racking of the BB are used for the movement of the first stitch 11. According to S1, a double stitch 13 including the first stitch 11 and the second stitch 12 is formed on the knitting needle D of the FB.

In S2, knitting of a pickup stitch (new base stitch 14) on the knitting needle B of the FB and knitting of a retaining stitch 15 following in the wale direction of the double stitch 13 formed on the knitting needle D of the FB are continuously carried out (corresponding to first process $\alpha_2$). By continuously carrying out the forming of the new base stitch 14 and the knitting of the retaining stitch 15, a state in which the new base stitch is directly connected to the retaining stitch 15, that is, a state in which the new base stitch 14 is branched from the retaining stitch 15 is obtained. A stitch may be knitted continuously in the wale direction of the pickup stitch, and such stitch may be assumed as the new base stitch 14. In this case, a small mesh hole can be formed in the suppressing section 4.

In the next S3 and S4, knitting similar to S1 and S2 is repeated. In repeating such knitting, the retaining stitch 15 knitted with the knitting needle D of the FB in S2 is assumed as the first stitch 11. The stitch of the knitting needle F of the FB that is proximate to the first stitch 11 (retaining stitch 15) in the moving direction DR is assumed as the second stitch 12. Here, since the new base stitch 14 is branched from the retaining stitch 15 in S2 and the retaining stitch 15 is assumed as the new first stitch 11, the new base stitch 14 can be said as being branched from the first stitch 11.

In S3, the first stitch 11 held on the knitting needle D of the FB is moved in the moving direction DR, and overlapped with the second stitch 12 held on the knitting needle F of the FB (corresponding to second process $\alpha_1$). According to S3, the double stitch 13 including the first stitch 11 and the second stitch 12 is formed on the knitting needle F of the FB.

In S4, the forming of the pickup stitch (new base stitch 14) on the knitting needle D of the FB and the knitting of the retaining stitch 15 following in the wale direction of the double stitch 13 formed on the knitting needle F of the FB are continuously carried out (corresponding to second process $\alpha_2$).

As described above, the suppressing section 4 can be formed by carrying out the knitting of the new base stitch 14 once each time the bind-off process is carried out once (see S4). Furthermore, if the suppressing section 4 is to be extended in the moving direction DR, knitting similar to S3 and S4 may be carried out assuming the retaining stitch 15 of the knitting needle F of the FB as the first stitch 11 and the stitch of the knitting needle H of the FB as the second stitch 12, as shown in S4.

<<Effect>>

The suppressing section 4 knitted according to the knitting process of FIG. 1 is less likely to stretch in the knitting width direction of the knitted fabric. This is because the double stitch 13 is formed by the bind-off process when forming the suppressing section 4, and the first stitch 11 and the second stitch 12 configuring the double stitch 13 restrict the respective movement.

The suppressing section 4 is formed when the new base stitch 14 branched from the first stitch 11 which is removed from the needle bed by the bind-off process is held on the needle bed in place of the first stitch 11. Since the knitting of the knitted fabric can be continued following the new base stitch 14, the suppressing section 4 can be formed in the middle of the wale direction of the knitted fabric although the bind-off process is being used.

The suppressing section 4 can be formed successively in the wale direction. In this case, the knitting process shown in FIG. 1 is to be performed on the new base section 14. The effect of preventing the stretch of the suppressing section 4 can be enhanced by successively forming the suppressing section 4.

<Second Embodiment>

In a second embodiment, a method for knitting the knitted fabric of the present invention that uses split knitting when branching the new base stitch 14 from the portion to be bind-off processed in the suppressing section 4 will be described based on the knitting process diagram of FIG. 2.

T0 shows a state in which the stitches of the knitted fabric in the process of knitting are held on the knitting needles B, D, F, H, J, and L of the FB. From this state, the suppressing section 4 (see T5) of suppressing the stretch in the knitting width direction of the knitted fabric is knitted. First, the first stitch 11 that serves as a basis for starting the knitting of the suppressing section 4 is determined. In the present embodiment, the stitch held on the knitting needle B of the FB is assumed as the first stitch 11. Furthermore, in the present embodiment, each of the stitches held on the knitting needles D, F, H, J, L of the FB lined in the moving direction DR with respect to the first stitch 11 is assumed as a moving side stitch 20. The number of stitches selected as the moving side stitch 20 determines the width of the suppressing section 4.

In T1, the split knitting is carried out continuously on the first stitch 11 of the knitting needle B of the FB and the moving side stitches 20 of the knitting needles D, F, H, J, and L of the FB (corresponding to process $\beta_1$). The first stitch 11 and the moving side stitches 20 are respectively transferred to the knitting needle B of the BB and the knitting needles D, F, H, J, and L of the BB by the split knitting. The new base stitch 14 pulled out from the first stitch 11 is knitted on the knitting needle B of the FB and the new base stitch 14 pulled out from each moving side stitch 20 of the knitting needles D, F, H, J, L of the BB is knitted on the knitting needles D, F, H, J, L of the FB by the split knitting. The new base stitch 14 branched from the first stitch 11 is knitted by the split knitting of T1.

In T2, the first stitch 11 of the knitting needle B of the BB is moved in the moving direction DR and overlapped with the moving side stitch 20 (see T1) of the knitting needle D of the BB to form the double stitch 13 (corresponding to first process $\beta_2$). The moving side stitch 20 of the knitting needle D in T1 is the second stitch 12 that is proximate to the first stitch 11 in the moving direction DR. The moving side stitch 20 (second stitch 12) of the knitting needle D of the BB is the stitch transferred from the FB to the BB by the split knitting of T1, and the new base stitch 14 of the knitting needle D of the FB is branched from the moving side stitch 20 (second stitch 12) as shown in T1.

In T3, the retaining stitch 15 following in the wale direction of the double stitch 13 formed in T2 is knitted (corresponding to first process $\beta_3$). The first bind-off process is terminated by the knitting of the retaining stitch 15.

In the next T4 and T5, knitting similar to T2 and T3 described above is repeated. In repeating such knitting, the retaining stitch 15 knitted with the knitting needle D of the BB in T3 is assumed as the new first stitch 11. The moving side stitch 20 of the knitting needle F of the BB that is proximate to the first stitch 11 (retaining stitch 15) in the moving direction DR is assumed as the second stitch 12.

In T4, the first stitch 11 held on the knitting needle D of the BB is moved in the moving direction DR, and overlapped with the second stitch 12 held on the knitting needle F of the BB (corresponding to second process $\beta_2$). According to T4, the double stitch 13 including the first stitch 11 and the second stitch 12 is formed on the knitting needle F of the BB.

In T5, the retaining stitch 15 following in the wale direction of the double stitch 13 formed in T4 is knitted (corresponding to second process $\beta_3$). The second bind-off process is terminated by the knitting of such retaining stitch 15. Thereafter, the knitting similar to T4 and T5 is repeated to complete the suppressing section 4. After the suppressing section 4 is completed, the knitting of the knitted fabric is to be continued following the new base section 14 held on the needle bed.

According to the knitting processes described above as well, the suppressing section 4 in which the stretch in the knitting width direction of the knitted fabric is suppressed can be formed in the middle of the wale direction of the knitted fabric. The interval of the stitches of the suppressing section 4 can be made shorter by using the split knitting when branching the new base stitch 14 from the portion to be bind-off processed in the suppressing section 4.

According to the knitting processes of the present embodiment, the bind-off process is carried out on the back side of the new base stitch 14, and thus the suppressing section 4 does not stand out.

<Third Embodiment>

In the second embodiment, the split knitting of a plurality of times is carried out all at once at the start of knitting of the suppressing section 4 so that all the new base stitches 14 in the suppressing section 4 are knitted at one time. On the contrary, in the third embodiment, a method for knitting the knitted fabric of the present invention of carrying out the bind-off process each time the split knitting of knitting the new base stitch 14 is carried out once will be described based on the knitting process diagram of FIG. 3.

U0 shows a state in which the stitches of the knitted fabric in the process of knitting are held on the knitting needles B, D, F, H, J, and L of the FB. From this state, the suppressing section 4 (see U6) of suppressing the stretch in the knitting width direction of the knitted fabric is knitted. First, the first stitch 11 that serves as a basis for starting the knitting of the suppressing section 4 is determined. In the present embodiment, the stitch held on the knitting needle B of the FB is assumed as the first stitch 11.

In U1, the split knitting is carried out with respect to the first stitch 11 on the knitting needle B of the FB (corresponding to first process $\gamma_1$). The first stitch 11 is transferred to the knitting needle B of the BB by the split knitting. The new base stitch 14 pulled out from the first stitch 11 is knitted with the knitting needle B of the FB by the split knitting.

In U2, the first stitch 11 of the knitting needle B of the BB is moved in the moving direction DR and overlapped with the second stitch 12 (see U1) on the knitting needle D of the FB to form the double stitch 13 (corresponding to first process $\gamma_2$). The second stitch 12 is a stitch that was proximate to the first stitch 11 in the moving direction DR in U0, that is, a stitch that was proximate to the first stitch 11 in the moving direction DR before carrying out the split knitting on the first stitch 11.

In U3, the retaining stitch 15 following in the wale direction of the double stitch 13 formed in U2 is knitted (corresponding to first process $\gamma_3$). The first bind-off process is terminated by the knitting of the retaining stitch 15.

In following U4 to U6, knitting similar to U1 to U3 described above is repeated. In repeating the knitting, in U4, the retaining stitch 15 knitted with the knitting needle D of the FB in U3 is assumed as the new first stitch 11, and the split knitting is carried out (corresponding to second process $\gamma_1$). Furthermore, the stitch of the knitting needle F of the FB that is proximate to the first stitch 11 (retaining stitch 15) in the moving direction DR is assumed as the second stitch 12.

In U5, the first stitch 11 held on the knitting needle D of the BB is moved in the moving direction DR and overlapped with the second stitch 12 held on the knitting needle F of the FB (corresponding to second process $\gamma_2$). The double stitch 13 including the first stitch 11 and the second stitch 12 is formed on the knitting needle F of the FB by the U5.

In U6, the retaining stitch 15 following in the wale direction of the double stitch 13 formed in U5 is knitted (corresponding to second process $\gamma_3$). The second bind-off process is terminated by the knitting of the retaining stitch 15. Subsequently, the knitting similar to U4 to U6 is repeated, and the suppressing section 4 is completed. After the suppressing section 4 is completed, the knitting of the knitted fabric is to be continued following the new base section 14 held on the needle bed.

According to the knitting processes described above, the suppressing section 4 in which the stretch in the knitting width direction of the knitted fabric is suppressed can be formed in the middle in the wale direction of the knitted fabric. The intervals of the stitches of the suppressing section 4 can be made shorter by using the split knitting when branching the new base stitch 14 from the portion to be bind-off processed in the suppressing section 4.

<Fourth Embodiment>

In a fourth embodiment, an example in which the method for knitting the knitted fabric of the present invention is applied to the knitting of the shoe upper will be described based on FIG. 4.

<<Overall Configuration>>

Figure 4:
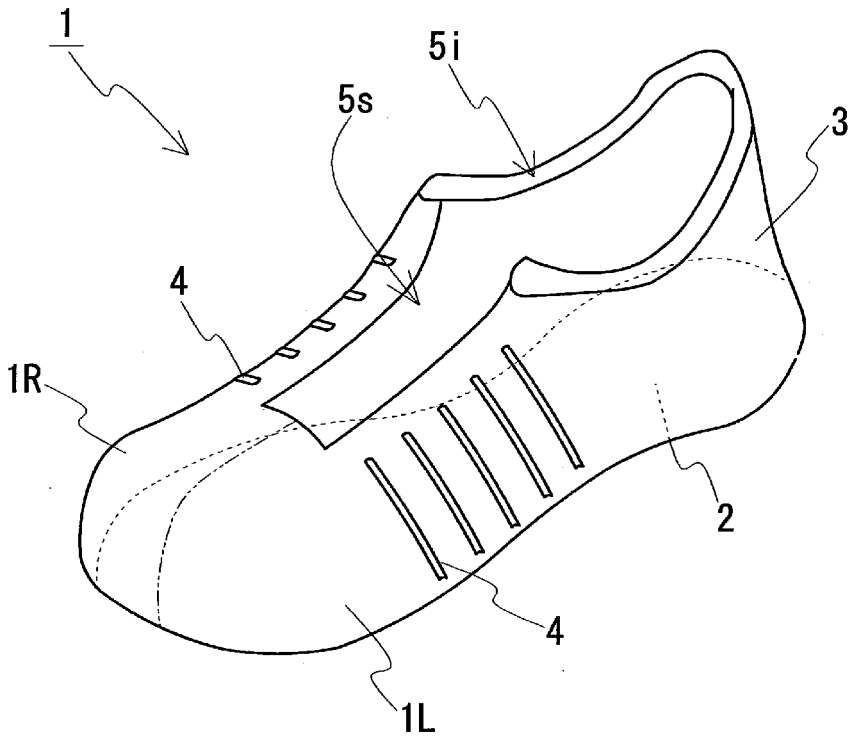
FIG. 4 is a schematic configuration view of a shoe upper including a portion knitted by applying a method for knitting a knitted fabric of the present invention shown in a fourth embodiment.

A shoe upper 1 (knitted fabric) of the present embodiment shown in FIG. 4 includes an instep cover section 3 that covers the portion on the instep side of the foot of the wearer, and a sole cover section 2 that covers the portion of the sole of the wearer. The instep cover section 3 is formed with a foot insertion opening **5*i* and a slit 5*s* extending from the foot insertion opening 5*i* toward the toe, so that the foot can be easily inserted from the foot insertion opening 5*i*. In the shoe upper 1, a plurality of suppressing sections 4 extending toward the side from the vicinity of the hem portion of the slit 5*s* in the instep cover section 3 is formed. The forming position and the forming range of the suppressing section 4** are not, of course, limited thereto. For example, the suppressing section 4 may be formed on the toe side. Furthermore, the suppressing section 4 of FIG. 4 may be extended to the sole cover section 2 beyond the boundary position of the instep cover section 3 and the sole cover section 2.

<<Procedure for Producing Shoe Upper>>

The shoe upper 1 can be produced by knitting the right side portion 1R of the instep cover section 3 and the sole cover section 2 with one needle bed of the flat knitting machine, and knitting the left side portion 1L of the instep cover section 3 and the sole cover section 2 with the other needle bed. For example, the knitting is started from the toe side of the shoe upper 1, and the shoe upper 1 is knitted to the position of cut end of the slit 5*s* by tubular knitting and the like.

Figure 2:
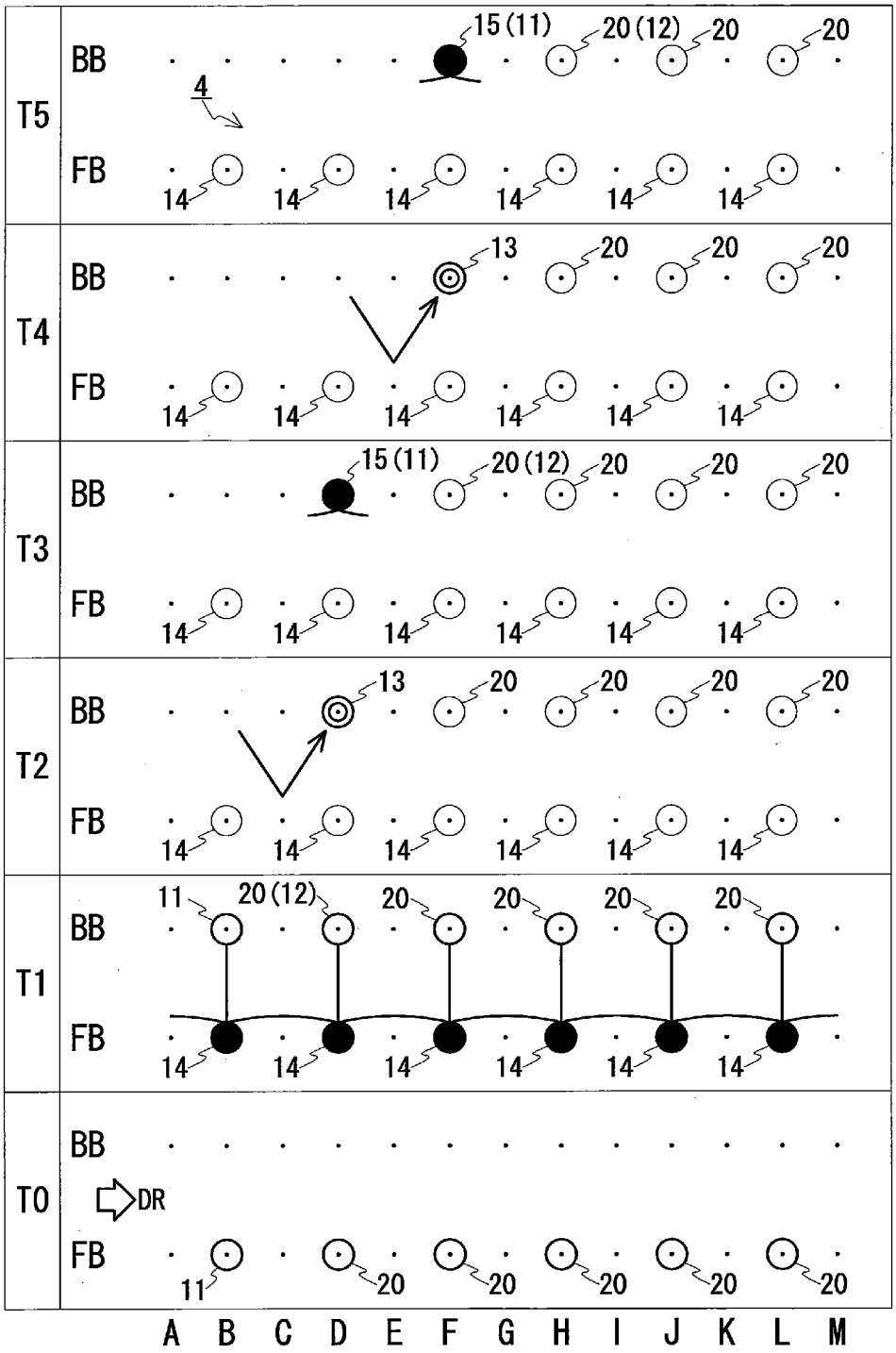
FIG. 2 is a knitting process diagram of a method for knitting a knitted fabric of the present invention shown in a second embodiment.
Figure 3:
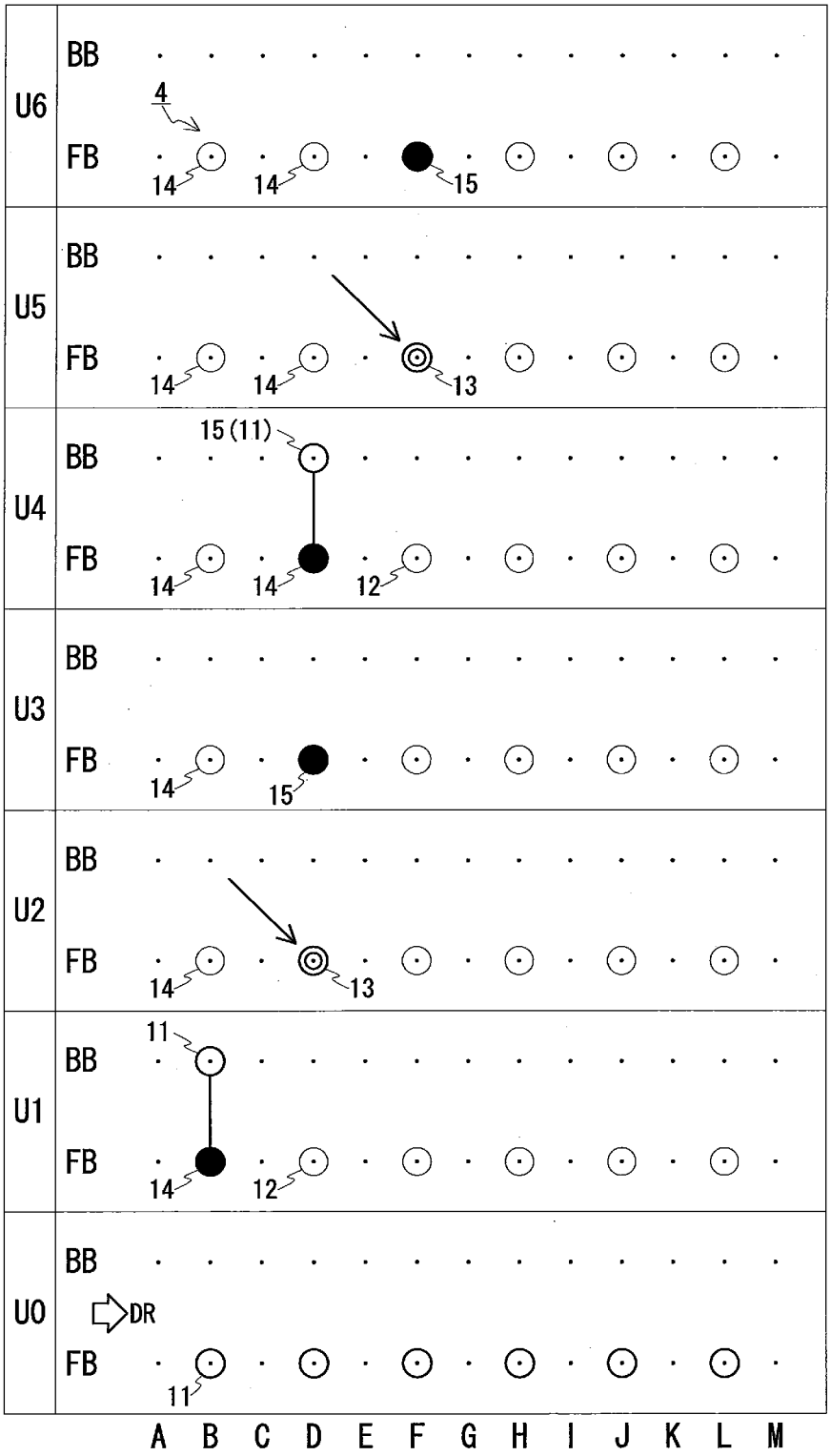
FIG. 3 is a knitting process diagram of a method for knitting a knitted fabric of the present invention shown in a third embodiment.

Next, the right side portion 1R and the left side portion 1L are knitted by C-shaped flechage knitting and the suppressing section 4 is formed using the method for knitting the knitted fabric of the present invention described using FIGS. 1 to 3 at a predetermined position. As already described above, the knitted fabric can be further knitted following the suppressing section 4, so that the knitting of the shoe upper 1 is not interrupted by the suppressing section 4 and the shoe upper 1 can be integrally knitted in a seamless manner.

After the suppressing section 4 arranged closest to heel side in FIG. 4 is formed, the knitting of the shoe upper 1 is continued toward the heel of the shoe upper 1 to complete the shoe upper 1. The shoe upper 1 may be set up from the heel side and the knitting may be terminated on the toe side.

<<Effect of Shoe Upper>>

In the shoe upper 1 knitted according to the knitting procedure described above, the stretch toward the side of the shoe upper 1 is suppressed by the suppressing section 4. The shoe upper 1 is less likely to lose shape and the fitting property of the shoe upper 1 with respect to the foot of the wearer enhances by suppressing the stretch of the relevant portion.

<<Others>>

The knitting yarn configuring the shoe upper 1 preferably includes a heat fusible yarn. The shoe upper 1 thus can be three-dimensionally shaped by fitting the shoe upper 1 to a last and performing heat process after terminating the knitting of the shoe upper 1.

DESCRIPTION OF SYMBOLS

1 shoe upper
1R right side portion
1L left side portion
2 sole cover section
3 instep cover section
4 suppressing section
5*i* foot insertion opening
5*s* slit
11 first stitch
12 second stitch
13 double stitch
14 new base stitch
15 retaining stitch
20 moving side stitch
DR moving direction

The invention claimed is:

1. A method for knitting a knitted fabric comprising:

forming a suppressing section for suppressing stretch in a knitting width direction of the knitted fabric in a middle of a wale direction of the knitted fabric using a flat knitting machine including at least a pair of a front and a back needle beds and in which stitches are transferrable between the front and back needle beds; wherein a direction to one side of a longitudinal direction of the needle beds defines a first direction, and process $\alpha_1$ of moving a first stitch that serves as a basis in the first direction and overlapping the first stitch and a second stitch that is forward from the first stitch relative to the first direction on the one needle bed to form a double stitch, and process $\alpha_2$ of continuously carrying out forming of a new base stitch on a knitting needle of the one needle bed, on which the first stitch was held before being moved, and knitting of a retaining stitch following in the wale direction of the double stitch formed in the process $\alpha_1$, are repeated, so that the suppressing section is formed by a bind-off process in which the double stitch is formed and the retaining stitch is knitted, and a plurality of the new base stitches are formed from the suppressing section (4); provided that n is a natural number greater than or equal to one, the $n+1^{th}$ process $\alpha_1$ is carried out assuming the retaining stitch in the $n^{th}$ process $\alpha_2$ is the first stitch in the $n+1^{th}$ process $\alpha_1$.

2. A method for knitting a knitted fabric comprising:

forming a suppressing section for suppressing stretch in a knitting width direction of the knitted fabric in a middle of a wale direction of the knitted fabric using a flat knitting machine including at least a pair of a front and a back needle beds and in which stitches are transferrable between the front and back needle beds; wherein a direction to one side of a longitudinal direction of the needle beds defines a first direction, process $\beta_1$ of carrying out split knitting continuously on a first stitch that serves as a basis and on a plurality of moving side stitches lined in the first direction with respect to the first stitch to transfer the first stitch and the moving side stitches from the one needle bed to the other needle bed, and knitting a plurality of new base stitches on the knitting needles of the one needle bed, on which the first stitch and the moving side stitches were held, is carried out, and process $\beta_2$ of defining the moving side stitch that is forward from the first stitch relative to the first direction, among the moving side stitches transferred to the other needle bed by the split knitting of the process $\beta_1$, as a second stitch, and moving the first stitch in the first direction and overlapping the first stitch and the second stitch on the other needle bed to form a double stitch, and process $\beta_3$ of knitting a retaining stitch following in the wale direction of the double stitch formed in the process $\beta_2$, are repeated, so that the suppressing section is formed by a bind-off process in which the double stitch is formed and the retaining stitch is knitted, and a plurality of the new base stitches are formed from the suppressing section; provided that n is a natural number greater than or equal to one, the $n+1^{th}$ process $\beta_2$ is carried out assuming the retaining stitch in the $n^{th}$ process $\beta_3$ is the first stitch in the $n+1^{th}$ process $\beta_2$.

3. A method for knitting a knitted fabric comprising:

forming a suppressing section for suppressing stretch in a knitting width direction of the knitted fabric in a middle of a wale direction of the knitted fabric using a flat knitting machine including at least a pair of a front and a back needle beds and in which stitches are transferrable between the front and back needle beds; wherein a direction to one side of a longitudinal direction of the needle beds defines a first direction, and process $\gamma_1$ of carrying out split knitting on a first stitch that serves as a basis, to transfer the first stitch from the one needle bed to the other needle bed, and knitting a new base stitch on the knitting needle of the one needle bed on which the first stitch was held;

process $\gamma_2$ of defining a stitch that was forward from the first stitch relative to the first direction on the one needle bed before carrying out the split knitting as a second stitch, and moving the first stitch in the first direction and overlapping the first stitch and the second stitc on the one needle bed to form a double stitch; and process $\gamma_3$ of knitting a retaining stitch following in the wale direction of the double stitch formed in the process $\gamma_2$, are repeated, so that the suppressing section is formed by a bind-off process in which the double stitch is formed and the retaining stitch is knitted, and a plurality of the new base stitches are formed from the suppressing section; provided that n is a natural number greater than or equal to one, the $n+1^{th}$ process $\gamma_1$is carried out assuming the retaining stitch in the $n^{th}$ process $\gamma_3$ is the first stitch in the $n+1^{th}$ process $\gamma_1$.

* * * * *